US006516172B1

(12) United States Patent
Kimura

(10) Patent No.: US 6,516,172 B1
(45) Date of Patent: Feb. 4, 2003

(54) METHOD AND APPARATUS FOR COLLECTING DISCHARGED TONER FROM A DISCHARGED TONER BOX WITH A DISCHARGED TONER NOZZLE AND A CONNECTING PORTION

(75) Inventor: Hisashi Kimura, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/939,575

(22) Filed: Aug. 28, 2001

(51) Int. Cl.[7] ..... G03G 15/08; G03G 21/12
(52) U.S. Cl. ..... 399/257; 399/360
(58) Field of Search ..... 399/35, 98, 257, 399/358, 360

(56) References Cited

U.S. PATENT DOCUMENTS 4,030,824 A * 6/1977 Smith ..... 399/360
5,383,578 A * 1/1995 Nishimura ..... 399/360 X

FOREIGN PATENT DOCUMENTS

JP 8-328368 12/1996

* cited by examiner

*Primary Examiner*—William J. Royer
(74) *Attorney, Agent, or Firm*—Foley & Lardner

(57) ABSTRACT

When a discharged toner box 3 is detached, discharged toner is prevented from being scattered. A discharged toner collecting apparatus 1 includes a discharged toner box 3 for storing discharged toner, a discharged toner nozzle 4 for injecting discharged toner into the interior of the discharged toner box 3, and a connecting portion 5 to which the nozzle 4 is connected. At the position where the nozzle 4 and the connecting portion 5 are connected, a washing fluid feeding unit 6 for feeding washing water to wash the inner surface of the nozzle 4 is provided. The washing fluid feeding unit 6 is constituted by a washing fluid tank 14 for storing washing water, a washing fluid nozzle 15 for ejecting the washing water to an inner surface of the nozzle 4, and the washing fluid feeding unit 16 for feeding the washing water to the nozzle 15. The nozzle 15 is constituted by a circular pipe portion 18 which surrounds a vertical pipe unit 13, and flow control vanes 19 for guiding the washing water to the interior of the vertical pipe unit 13. The washing water is caused to flow from slits 19A formed between the flow control vanes 19 to the interior thereof in a swirly manner so as to wash the discharged toner adhered on the inner surfaces thereof.

8 Claims, 6 Drawing Sheets

METHOD AND APPARATUS FOR COLLECTING DISCHARGED TONER FROM A DISCHARGED TONER BOX WITH A DISCHARGED TONER NOZZLE AND A CONNECTING PORTION

BACKGROUND OF THE INVENTION

1. Field of the Invention

The present invention relates to a discharged toner method and a discharged toner apparatus which executes collecting discharged toner in copy machines, printers and the like.

2. Description of Related Art

In a copy machine, a printer and the like, printing is conducted, in general, using toner stored in a toner cartridge. Toner discharged during printing is stored in a discharged toner box.

The discharged toner box is connected via a connecting portion to a discharged toner nozzle provided at the body of the copy machine.

When the discharged toner box is filled to the top with discharged toner, the discharged toner box is detached from the toner nozzle by releasing the connecting portion therefrom, and then the discharged toner box is handled outside the machine.

However, in the above-mentioned conventional copy machines, printer and the like, it is problematic that the discharged toner is scattered to contaminate the machine. Specifically, when the discharged toner box is replaced, the discharged toner is liable to be spilt from the discharged toner box due to vibration generated during replacement of the toner box, thereby contaminating the interior of the machine.

The present invention is accomplished in view of the above-mentioned problem, and its object is to provide a method and apparatus for preventing contamination caused by spilt toner generated during replacement of the discharged toner box.

SUMMARY OF THE INVENTION

A first aspect of the present invention provides a discharged toner collecting method, wherein, in a case where a discharged toner box containing discharged toner stored therein is replaced so as to collect the discharged toner, when a discharged toner nozzle, which is connected to a connecting portion provided at the discharged toner box and adapted to inject discharged toner into the interior of the discharged toner box, is released from the connecting portion, the discharged toner nozzle, or both of the discharged toner nozzle and the connecting portion, are washed by means of washing fluid.

Owing to this configuration, the discharged toner nozzle is washed by the washing fluid whereby the discharged toner adhered on the inner surface of the discharged toner nozzle is removed. Accordingly, when the discharged toner box is detached from the connecting portion, the discharged toner is prevented from being spilt or scattered. Consequently, contamination of the interior of the machine is prevented.

In this configuration, it is preferred that inner surfaces of the discharged toner nozzle and the connecting portion are cylindrically-shaped, and the washing fluid is caused to flow in a swirly manner along the cylindrically-shaped inner surfaces so as to wash the inner surfaces.

Owing to this configuration, the discharged toner adhered on the cylindrically-shaped inner surface can be washed efficiently by causing the washing fluid to flow in a swirly manner along the inner surface thereof.

Further, it is preferred that the washing fluid is a liquid, a gas or a grain-like material capable of removing discharged toner adhered on the inner surface of the discharged toner nozzle or the connecting portion.

Owing to this configuration, in the case where the washing fluid is water, water containing a detergent and the like, the washing fluid flows along the inner surface of the discharged toner nozzle so as to wash away the adhered discharged toner.

In the case where the washing fluid is a gas such as air, the gas is blown along the inner surface of the discharged toner nozzle and concurrently air is sucked from the discharged toner box. Thereby, the discharged toner adhered on the inner surface of the discharged toner nozzle is blown away to be removed, and sucked into the discharged toner box.

In the case where the washing fluid is a grain-like material such as granule, the grain-like material is caused to flow along the inner surface of the discharged toner nozzle. Thereby, the discharged toner adhered on the inner surface of the discharged toner nozzle falls downward together with the grain-like material into the discharged toner box.

A second aspect of the present invention provides a discharged toner collecting apparatus including at least a discharged toner box for storing discharged toner, a discharged toner nozzle for injecting discharged toner into the discharged toner box, and a connecting portion which is provided in the discharged toner box and to which the discharged nozzle is connected, wherein there is provided, at a position where the discharged toner nozzle and the connecting portion are connected, a washing fluid feeding mechanism for feeding washing fluid to wash an inner surface of the discharged nozzle, or both of inner surfaces of the discharged toner nozzle and the connecting portion.

Owing to this configuration, the washing fluid feeding mechanism feeds washing fluid to the discharged toner nozzle or to the connected position where the discharged toner nozzle and the connecting unit are connected, whereby the inner surface of the discharged toner nozzle, or both of inner surfaces of the discharged toner nozzle and the connecting portion, are washed away by the washing fluid, thereby removing the discharged toner. Thereby, when the discharged toner nozzle is released from the connecting portion, the discharged toner is prevented from being spilt or scattered to the outside. Consequently, the problem that, when the discharged toner box is replaced, the toner is spilt to contaminate the surroundings can be prevented.

Here, it is preferred that the washing fluid feeding mechanism comprises a washing fluid tank for storing washing fluid, a washing fluid nozzle for ejecting the washing fluid stored in the washing fluid tank to inner surfaces of the discharged toner nozzle, or both of inner surfaces of the discharged toner nozzle and the connecting portion, and a washing fluid feeding unit for feeding washing fluid stored in the washing fluid tank to the washing fluid nozzle.

Owing to this configuration, the washing fluid stored in the washing fluid tank is fed to the washing fluid nozzle by the washing fluid feeding mechanism and then ejected to the discharged toner nozzle or to both of the discharged toner nozzle and the connecting portion. Thereby, the discharged toner adhered on the inner surface of the discharged toner nozzle is removed. In this configuration, the washing fluid is caused to flow like a shower or in a swirly manner along the entire inner surface of the discharged toner nozzle so as to wash the entire inner surface of the discharged toner nozzle.

Here, it is preferred that the washing fluid nozzle is constituted by a circular pipe portion which is provided at an upper portion of the discharged nozzle and surrounds the discharged toner nozzle, and flow control vanes which constitute an inside wall provided inside the circular pipe portion and guides washing fluid flowing inside the circular pipe portion to the discharged toner nozzle.

Owing to this configuration, the washing fluid, which has flowed into the circular pipe portion, is filled inside the circular pipe portion, and then flows into the discharged toner nozzle while being guided by the flow control vanes. The washing fluid, which has flowed into the discharged toner nozzle, falls in a swirly manner, or falls vertically along the inner surface of the discharged toner nozzle, according to the shape of the flow control vanes.

Further, it is preferred that the discharged toner nozzle is formed in the shape of a cylindrical pipe; and the washing fluid nozzle is constituted by a circular pipe portion which is provided at an upper portion of the discharged toner nozzle and surrounds the discharged toner nozzle, and one or more flow control vanes which constitute an inside wall provided inside the circular pipe portion and guide the washing fluid flowing inside the circular pipe portion to the discharged toner nozzle so as to cause the washing fluid to flow in a swirly manner.

Owing to this configuration, the washing fluid circulates inside the circular pipe portion. The flow control vanes guide the washing fluid flowing in a circulating manner inside the circular pipe to the interior of the discharged toner nozzle so as to cause the washing fluid to flow in a swirly manner. This washing fluid flowing in a swirly manner washes away the discharged toner adhered on the inner surfaces to the discharged toner box while flowing along the inner surfaces of the discharged toner nozzle and the connecting portion.

As detailed above, according to the discharged toner collecting method and discharged toner collecting apparatus of the present invention, the discharged toner is prevented from being spilt or scattered when the discharged toner box is taken out, whereby contamination of the interior of the machine can be prevented.

BEST MODE FOR CARRYING OUT THE INVENTION

Hereinafter, a best mode of a method for collecting discharged toner (referred to as "discharged toner colleting method") and a best mode of an apparatus for collecting discharged toner (referred to as "discharged toner collecting apparatus") according to the present invention will be described with reference to the attached drawings.

First, the discharged toner collecting apparatus which executes the discharged toner collecting method.

Figure 2:
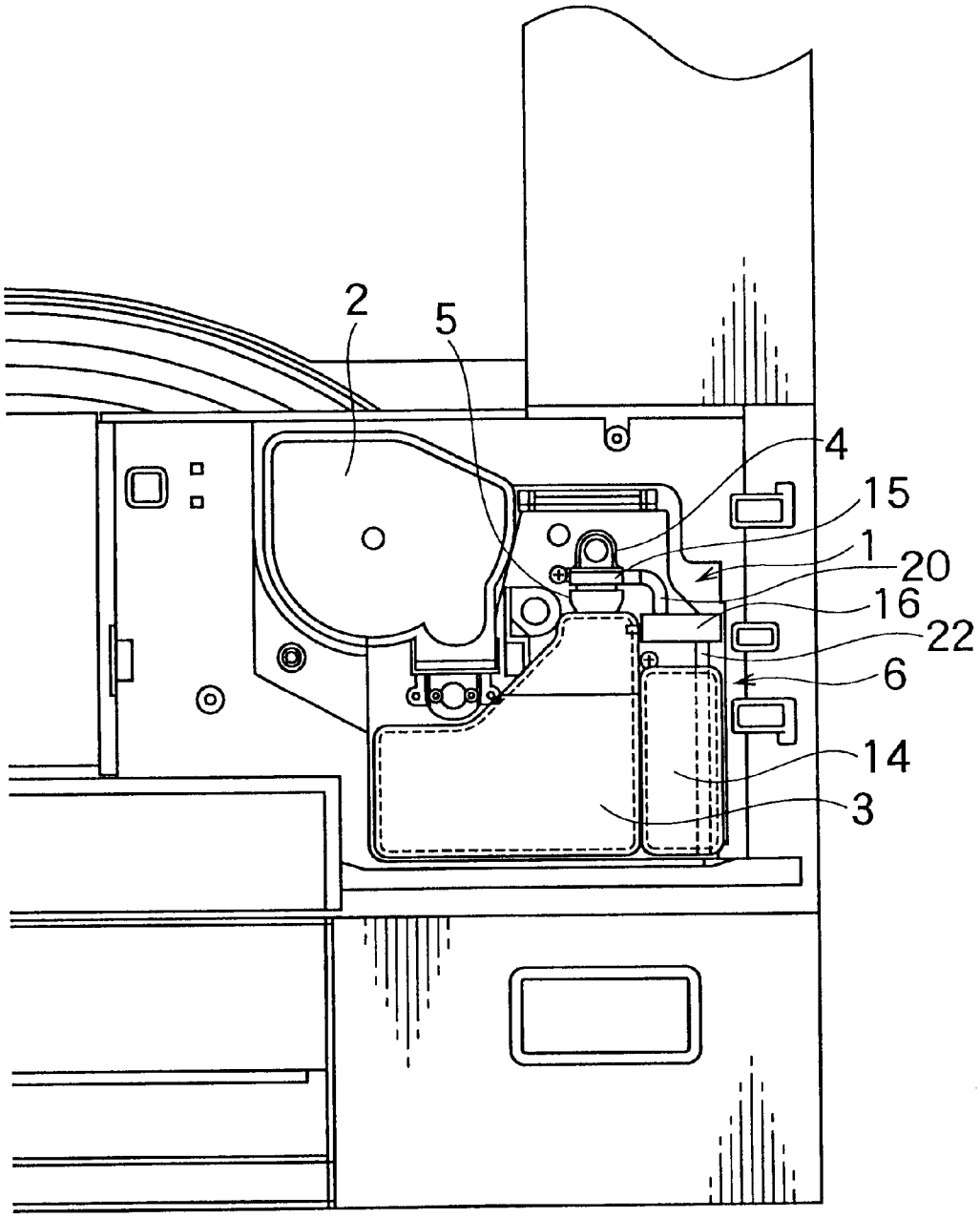
FIG. 2 is a partial front elevational view showing a main portion of a machine such as a printer according to the embodiment of the present invention.
Figure 3:
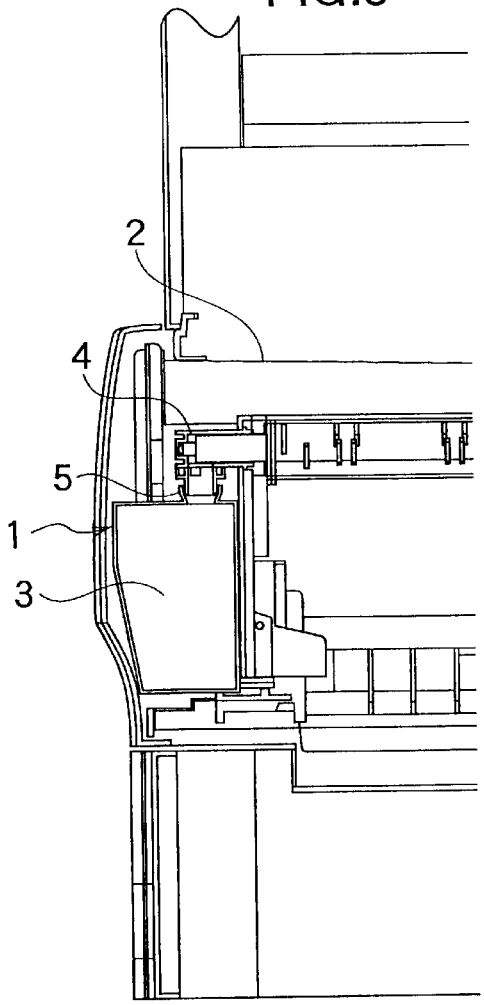
FIG. 3 is a partial side elevational view showing a main portion of a machine such as a printer according to the embodiment of the present invention.
Figure 4:
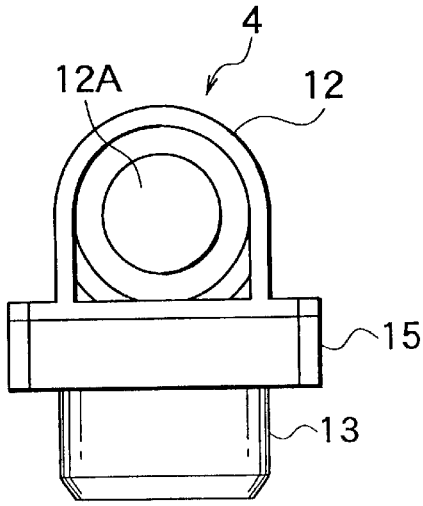
FIG. 4 is a front elevational view showing a discharged toner nozzle according to the embodiment of the present invention.
Figure 5:
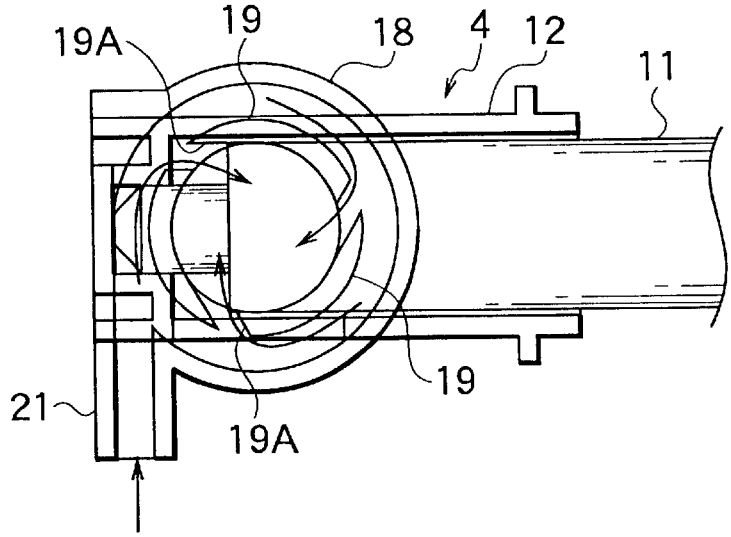
FIG. 5 is a schematic sectional view showing a discharged toner nozzle according to the embodiment of the present invention seen from the bottom.
Figure 6:
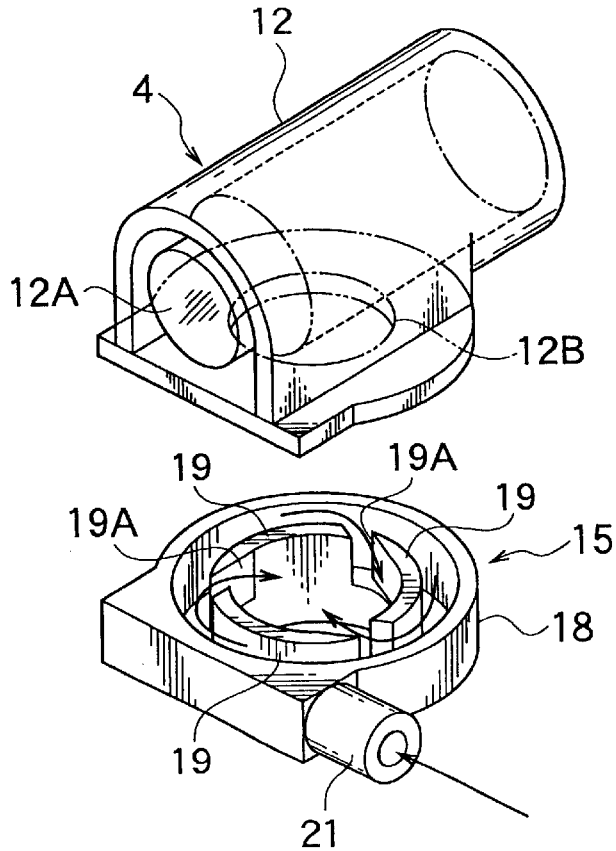
FIG. 6 is a perspective view showing a discharged toner nozzle and a washing fluid nozzle according to the embodiment of the present invention, in which the vertical pipe portion is not shown.

A discharged toner collecting apparatus 1 according to the present embodiment is an apparatus which is adapted to collect discharged toner caused by printing. The discharged toner collecting apparatus 1 is provided, as shown in FIGS. 2 and 3, adjacent to a toner cartridge 2 of a copy machine, a printer and the like. The discharged toner collecting apparatus 1 is constituted chiefly by a discharged toner box 3, a discharged toner nozzle 4, a connecting portion 5 and a washing fluid feeding unit 6.

The discharged toner box 3 is a box which is adapted to store discharged toner caused by printing. The discharged toner box 3 is provided directly under the toner cartridge 2 so as to receive and store the discharged toner conveyed from the toner cartridge 2. Further, the discharged toner box 3 is provided at one end portion (i.e., left edge portion of FIG. 3) in the longitudinal dimension of the toner cartridge 2 in such a manner as to be easily detached. The discharged toner box 3 is formed in a shape corresponding to the shape of a space where the discharged toner box 3 is provided (In the figure, the shape of the box 3 seen from the front is generally a triangle, and the shape of the box 3 seen from the side is generally a rectangle).

The inner surface of the ceiling plate of the discharged toner box 3 is provided with a toner detection sensor 7. The toner detection sensor 7 is adapted to detect a state in which the discharged toner box 3 is filled to the top with discharged toner. The toner detection sensor 7 is constituted by a known proximity sensor or optical sensor, and adapted to detect a state in which the discharged toner is accumulated up to the proximity of the ceiling plate of the discharged toner box 3. The toner detection sensor 7 is connected to a control unit (not shown) of a copy machine and the like. When the toner detection sensor 7 detects a state in which the interior of the discharged toner box 3 is full, the control unit of the copy machine and the like indicates the state by means of a lamp, buzzer and the like.

Figure 1:
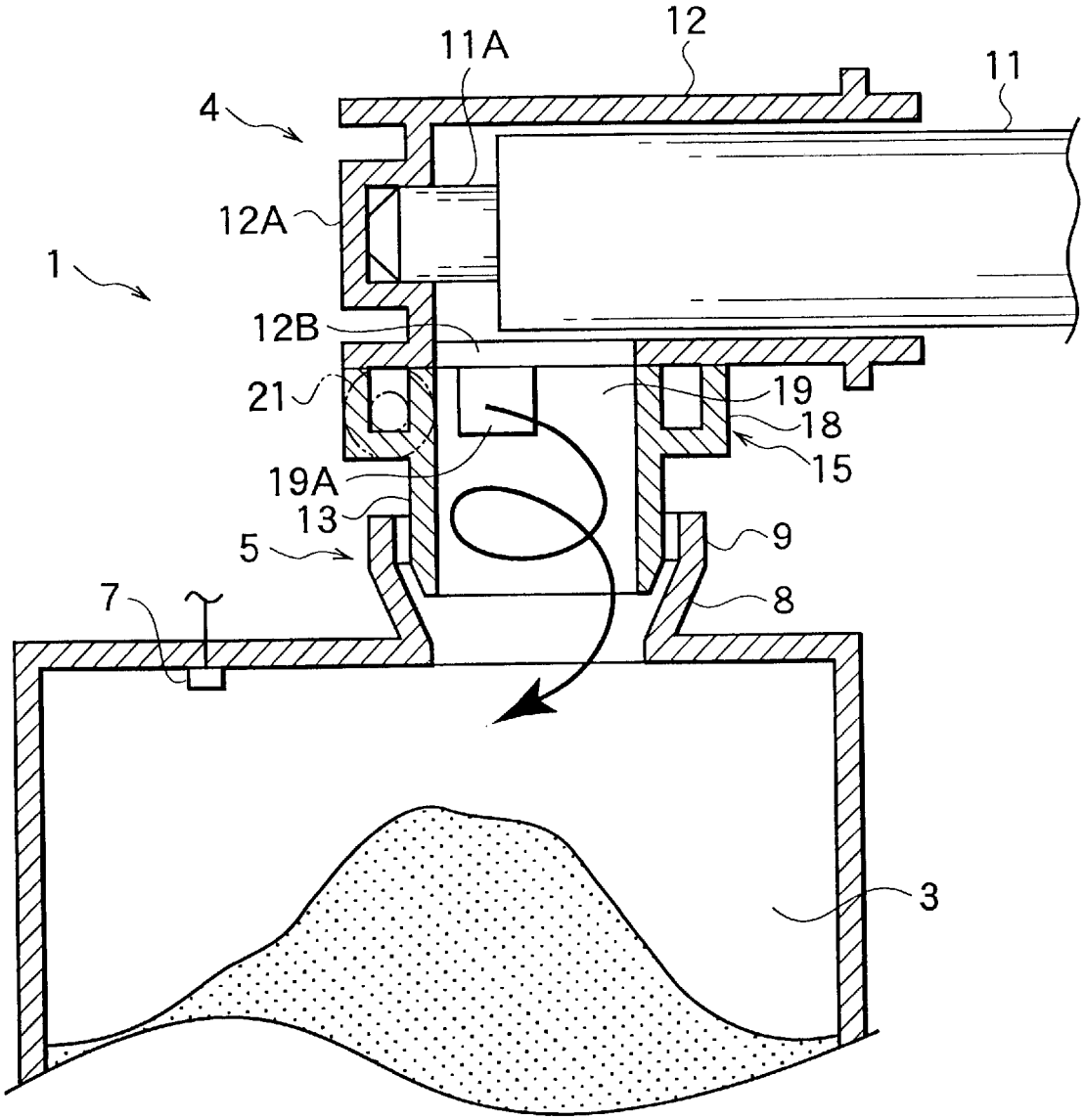
FIG. 1 is a sectional view showing a discharged toner collecting apparatus according to an embodiment of the present invention.

The upper portion of the discharged toner box 3 is provided with a connecting portion which is opened upward, as shown in FIG. 1. The connecting portion 5 is a member which is adapted to connect the discharged toner nozzle 4 to the discharged toner box 3. The connecting portion 5 is constituted by a funnel portion 8 and a connecting pipe portion 9. The funnel portion 8 is a portion which is adapted to guide discharged toner falling from the discharged toner nozzle 4 so as to introduce the discharged toner into the interior of the discharged toner box 3. The funnel portion 8 is integrally formed on the ceiling plate of the discharged toner box 3. The funnel portion 8 is opened upward, that is, the inner diameter of the funnel portion 8 gets larger toward the top. The connecting pipe portion 9 is a portion which is adapted to be joined to the lower end portion of a vertical pipe unit 13 of the discharged toner nozzle 4 so as to connect therebetween. The connecting pipe portion 9 is formed above the funnel portion 8 and continuously connected to the connecting pipe portion 9. The inner diameter of the connecting pipe portion 9 is determined to a dimension slightly larger than the outer diameter of the lower portion of the discharged toner nozzle 4 so as to enable the vertical pipe unit 13 to be easily attached and detached.

The discharged toner nozzle 4 is a member which is adapted to inject discharged toner into the interior of the discharged toner box 3. The discharged toner nozzle 4 is provided, as shown in FIGS. 1, 4, 5 and 6, immediately above the discharged toner box 3 in such a manner as to connect the discharged toner box 3 to a transfer auger 11.

The discharged toner nozzle 4 is constituted chiefly by a lateral pipe unit 12 and the vertical pipe unit 13. The lateral pipe unit 12 is a member which is adapted to receive discharged toner conveyed by the transfer auger 11 so as to convey the discharged toner to the vertical pipe unit 13. The lateral pipe unit 12 is formed, for example, in the shape of a cylinder, and provided at one end of the transfer auger 11. The lateral pipe unit 12 has, at the end portion thereof (i.e., left edge portion of FIG. 1), a bearing portion 12A is adapted to support a rotational shaft 11A of the transfer auger 11. The lateral pipe unit 12 has, at the lower edge portion thereof, an opening 12B which is in communication with the vertical pipe unit 13. The vertical pipe unit 13 is a member which is adapted to guide discharged toner fed from the lateral pipe unit 12 so as to inject the discharged toner into the interior of the discharged toner box 3. The vertical pipe unit 13 is formed, for example, in the shape of a cylinder, and provided in such a manner as to conform to the opening 12B of the lateral pipe unit 12. The lower edge portion of the vertical pipe unit 13 is tapered so as to be joined to the connecting pipe portion 9 of the connecting portion 5.

The washing fluid feeding unit 6 is a member which is adapted to feed washing fluid to wash the inner surfaces of the discharged toner nozzle 3 and the connecting portion 5. As shown in FIGS. 1, 2, 4, 5 and 6, the washing fluid feeding unit 6 is provided at a connected position between the discharged toner nozzle 4 and the connecting portion 5 (i.e., at a position in the vicinity of the portion where the discharged toner nozzle 4 and the connecting portion 5 are connected).

The washing fluid feeding unit 6 is constituted chiefly by a washing fluid tank 14, a washing fluid nozzle 15 and a washing fluid feeding unit 16. The following descriptions will be made assuming that the washing fluid is water.

The washing fluid tank 14 is a tank which is adapted to store washing water serving as the washing fluid. The washing fluid tank 14 is provided adjacent to the discharged toner box 3.

The washing fluid nozzle 15 is a member which is adapted to eject washing water stored in the washing fluid tank 14 to the inner surfaces of the discharged toner nozzle 4 and the connecting portion 5. The washing fluid nozzle 15 is constituted by a circular pipe portion 18 and flow control vanes 19. The circular pipe portion 18 is provided integrally at the upper edge portion of the vertical pipe unit 13 of the discharged toner nozzle 4, and adapted to allow the washing water to flow along the entire inner surface of the vertical pipe unit 13. The circular pipe portion 18 is formed in the shape of a circle so as to allow washing water to circulate therein, and is disposed in such a manner as to surround the outer surface of the vertical pipe unit 13. The circular pipe portion 18 has, at the outer surface thereof, a pipe connecting portion 21 to which a feeding pipe 20 is connected. The feeding pipe 20 is adapted to feed washing water, which has flowed from the washing fluid feeding unit 16, into the interior of the circular pipe portion 18. The pipe connecting portion 21 is provided in such a manner that it extends in the direction of the tangent to the outer surface of the circular pipe portion 18 so as to allow the washing water, which is fed into the circular pipe portion 18, to circulate therein at a certain flow speed.

The flow control vanes 19 are members each of which is adapted to guide the washing water flowing in the circular pipe portion 18 to the vertical pipe unit 13 of the discharged toner nozzle 4. The flow control vanes 19 are constituted by three elements which are disposed in a circular manner so as to serve as an inside wall provided inside the circular pipe portion 18. Slits 19A are formed between neighboring elements of the flow control vanes 19. Each slit 19A is disposed in such an oblique manner as to guide the washing water, which is circulating inside the circular pipe portion 18, inward (i.e., in the directions as indicated by the arrows in FIGS. 5 and 6) with respect to the course of the circulating washing water. Each slit 19A is formed at the upper edge portion of the vertical pipe unit 13, and opened inward with respect to the course of the washing water circulating inside the circular pipe portion 18. In this arrangement, the washing water, which has flowed from slits 19A into the interior of the vertical pipe unit 13, is caused to flow in a swirly manner from the upper edge of the vertical pipe unit 13 along the inner surface of the vertical pipe unit 13 to the lower edge thereof.

The washing fluid feeding unit 16 is a member which is adapted to feed the washing water stored in a washing fluid tank 14 the washing fluid nozzle 15. The washing fluid feeding unit 16 is constitutes chiefly by a pump, and adapted to suck washing water from a suction pipe 22, which is inserted into the washing fluid tank 14, so as to feed the sucked washing water via the feeding pipe 20 to the circular pipe portion 18 of the washing fluid nozzle 15.

The washing fluid feeding unit 16 is operated manually or automatically. In the case of manual operation, a manual operation button (not shown) is provided at the body of the copy machine. In this arrangement, when the interior of the discharged toner box 3 is filled to the top with discharged toner and accordingly the lamp or buzzer is actuated, the operator presses the manual operation button so as to actuate the washing fluid feeding unit 16 for a predetermined period of time. In the case of automatic operation, the washing fluid feeding unit 16, as well as the toner detection sensor 7, are connected to a control unit of the copy machine. In this arrangement, when the toner detection sensor 7 detects a state in which the discharged toner box 3 is full and accordingly the control unit of the copy machine receives a signal supplied from the sensor 7, the control unit causes the washing fluid feeding unit 16 to operate for a predetermined period of time. The operating time is a time which is needed for almost completely washing away the discharged toner adhered on the inner surfaces of the vertical pipe unit 13 of the discharged toner nozzle 4 and the connecting portion 5, and which is determined to an appropriate value according to respective conditions.

Next, the discharged toner collecting method, which is conducted using the discharged toner collecting apparatus 1 having the above-mentioned configuration, will be described.

The discharged toner, which is generated during use of a copy machine, is conveyed by the transfer auger 11, and then received by the lateral pipe unit 12 of the discharged toner nozzle 4. Thereafter, the discharged toner is conveyed via the vertical pipe unit 13 and the connecting portion 5 so as to be stored in the discharged toner box 3. Thereafter, when the discharged toner box 3 is filled to the top with the discharged toner as a result of use of the copy machine for a certain period of time, the toner detection sensor 7 detects a state in which the discharge toner box 3 is full. When the control unit of the copy machine receives the signal supplied from the toner detection sensor 7, the control unit causes a lamp or buzzer to indicate that the discharged toner box 3 is full.

In the case where the discharged toner collecting apparatus 1 is operated manually, the operator actuates the washing fluid feeding unit 16 for a certain period of time in response the indication by means of the lamp or buzzer. In the case of automatic operation, when the control unit of the copy machine receives a signal from the toner detection sensor 7, the control unit causes the lamp to indicate that the discharged toner box 3 is full and also actuates the washing fluid feeding unit 16 for a predetermined period of time.

Thereby, a predetermined amount of washing water stored in the washing fluid tank 14 is fed to the washing fluid nozzle 15. In the washing fluid nozzle 15, the washing water, which has flowed from the pipe connecting portion 21 thereinto, circulates inside the circular pipe portion 18 and concurrently flows via the slits 19A formed between the flow control vanes 19 into the vertical pipe unit 13 of the discharged toner nozzle 4. In the vertical pipe unit 13, the washing water, which has flowed from the slits 19A, is changed into a flow in a swirly manner (flow in a swirly manner is occasionally referred to as "swirl flow" throughout the specification) and goes downward along the inner surface of the connecting portion 5. Thereafter, the washing water flows in a swirly manner along the inner surface of the connecting portion 5, in particular, along the inner surface of the funnel portion 8 and falls into the discharged toner box 3.

The washing water washes away the discharged toner adhered on the inner surfaces of the vertical pipe unit 13 and the funnel portion 8 while flowing downward in a swirly manner and falling into the discharged toner box 3.

Next, the discharged toner box 3 is detached and taken out by releasing the connecting portion 5 of the discharged toner box 3 from the discharged toner nozzle 4, and instead an empty discharged toner box 3 is attached.

By way of the above-mentioned operations, the discharged toner adhered on the inner surfaces of the vertical pipe unit 13 and the funnel portion 8 of the connecting portion 5 can be removed. Thereby, the discharged toner is prevented from being spilt or scattered when the discharged toner box 3 is detached and taken out by releasing the connecting portion 5 of the discharged toner box 3 from the discharged toner nozzle 4. Accordingly, contamination of the interior of the machine can be prevented.

In the above-mentioned embodiment, although the flow control vanes 19 of the washing fluid nozzle 15 are constituted by three elements, the number of the elements of the flow control vanes may be one, two or four so long as a swirl flow can be generated because all the flow control vanes 19 need to do is to produce a swirl flow.

Figure 7:
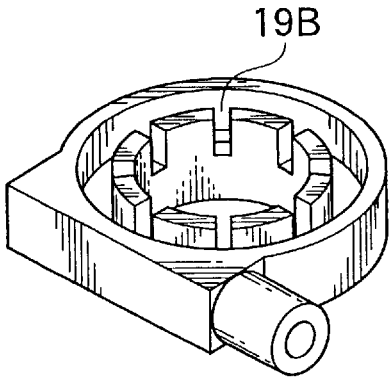
FIG. 7 is a perspective view showing a first modification.

Although the washing-away of the discharged toner is conducted by generating a swirl flow by means of the washing fluid nozzle 15, the washing-away may be realized by causing the washing water to flow in the form of shower. In this case, in place of the slits 19A of the washing fluid nozzle 15, a plurality of slits 19B in the form of teeth of a comb are provided, as shown in FIG. 7. This configuration also exhibits the same operations and advantages as those of the above-mentioned embodiment.

In the above-mentioned embodiment, although the washing water is caused to flow to both of the inner surfaces of the discharged toner nozzle 4 and the connecting portion 5, the apparatus may be configured in such a manner that the washing water falls directly into the discharged toner box 3 from the lower edge of the vertical pipe unit 13 while suppressing the force of the washing water flowing from the slits 19A. This is because most of the scattering of the discharged toner can be prevented when at least the inner surface of the discharged toner nozzle 4 is washed. This configuration also exhibits the same operations and advantages as those of the above-mentioned embodiment.

In the above-mentioned embodiment, although the washing fluid nozzle 15 of the washing fluid feeding unit 6 is provided at the upper edge portion of the vertical pipe unit 13 of the discharged toner nozzle 4, the position where the washing fluid nozzle 15 is provided is not limited to this upper edge portion. Specifically, the washing fluid nozzle 15 may be provided at a position which is in the vicinity of the connected portion between the discharged toner nozzle 4 and the connecting portion 5 and which enables the washing of the discharged toner nozzle 4.

In the above-mentioned embodiment, although ordinary water is used as the washing fluid, a fluid other than water may be employed. Examples of employable liquid include water containing a detergent dissolved therein, and a liquid which is not inflammable, contains no harmful material, and produces no bad effect on the surroundings (e.g., nearby parts made of resin or metal).

Figure 8:
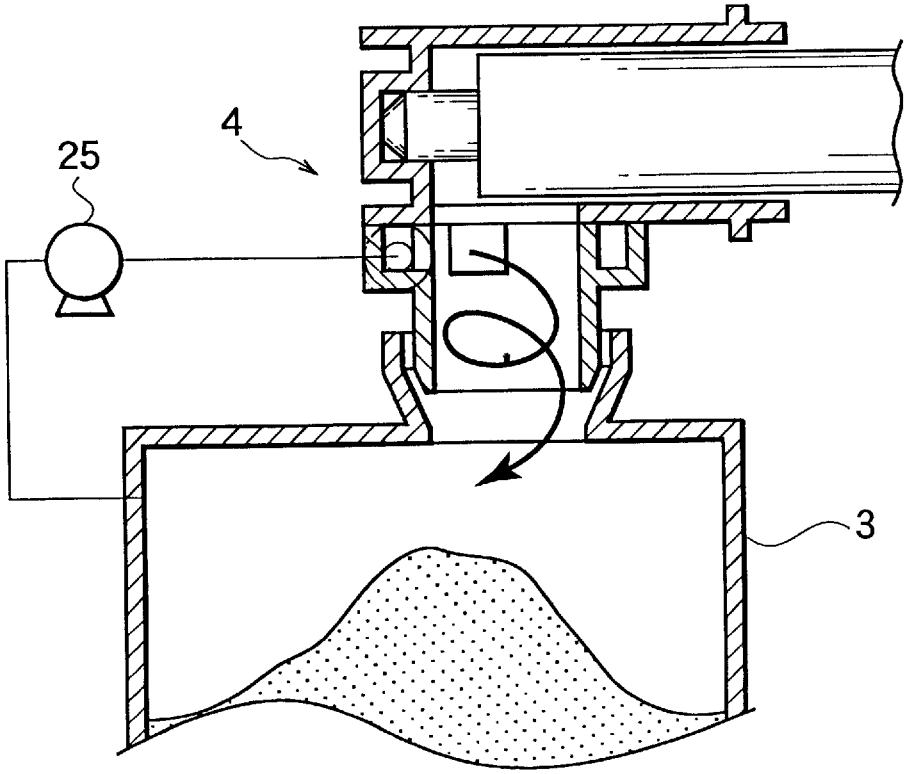
FIG. 8 is a view showing the general structure of a second modification.
Figure 9:
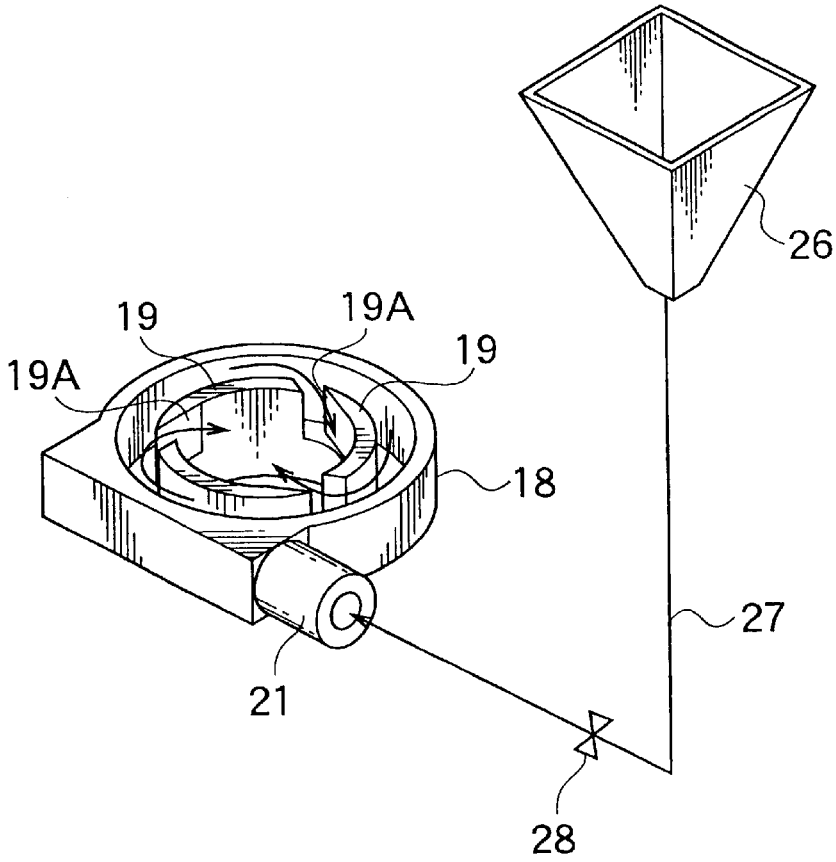
FIG. 9 is a perspective view showing the general structure of a third modification.

Also, the washing fluid may be a material other than a liquid, that is, it may be a gas or a grain-like material. In the case of a gas, a blower 25 is provided, as shown in FIG. 8, in such a manner that the blowing mouth is connected to the discharged toner nozzle 4 and the suction mouth is connected to the discharged toner box 3. In this arrangement, the blower 25 is actuated to blow the gas such as air to the inner surface of the discharged toner nozzle 4, and concurrently the air is sucked from the discharged toner box 3. Thereby, the discharged toner adhered on the inner surface of the discharged toner nozzle 4 is blown away, and also the discharged toner thus blown away is sucked into the discharged toner box 3.

In the case of a grain-like material such as a granule or a hopper 26, in which grain-like material is put, is connected via a pipe 27 to the pipe connecting portion 21. When a valve 28, which is provided at the pipe 27, is opened, the grain-like material put in the hopper 26 is conveyed via the circular pipe portion 18 and the slits 19A and falls along the inner surfaces of the vertical pipe unit 13 and the connecting portion 5 into the discharged toner box 3. The grain-like material, which falls along the inner surfaces of the vertical pipe unit 13 and the connecting portion 5, removes the discharged toner adhered on the inner surfaces of the vertical pipe unit 13 and the connecting portion 5.

The circular pipe portion 18 of the washing fluid nozzle 15 may be formed in a shape other than a circle. In the case where the washing fluid, which is once stored in the circular pipe portion 18, flows like a shower along the inner surface of the vertical pipe unit 13, it is not necessary to cause the washing water to circulate inside the circular pipe portion 18, and accordingly the circular pipe portion 18 may be formed in the shape of a rectangle or a polygon.

Figure 10:
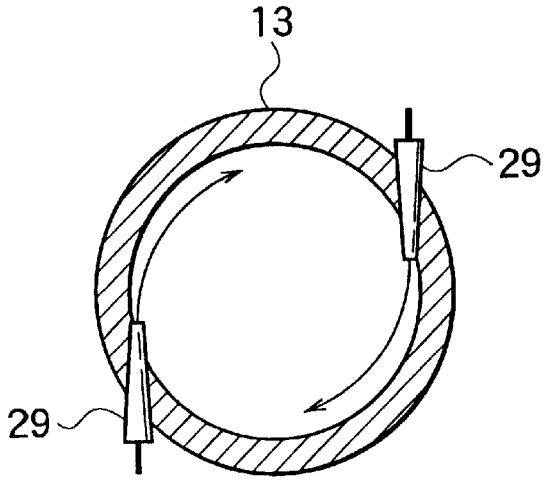
FIG. 10 is a plan view showing the general structure of a fourth modification.

In place of the slits 19A formed between the flow control vanes 19, one or plural ejection nozzles 29 may be directly provided at the vertical pipe unit 13, as shown in FIG. 10. The ejection nozzle 29 is provided on the inner surface of the vertical pipe unit 13 in such a manner as to be oriented in the direction of the tangent to the inner surface. This configuration also enables the swirl, flow to be assuredly produced inside the vertical pipe unit 13.

What is claimed is:

1. A discharged toner collecting method, wherein, in a case where a discharged toner box containing discharged toner stored therein is replaced so as to collect the discharged toner, when a discharged toner nozzle, which is connected to a connecting portion provided at the discharged toner box and adapted to inject discharged toner into the interior of the discharged toner box, is released from the connecting portion, the discharged toner nozzle, or both of the discharged toner nozzle and the connecting portion, are washed by means of washing fluid.

2. The discharged toner collecting method according to claim 1, wherein inner surfaces of the discharged toner nozzle and the connecting portion are cylindrically-shaped, and the washing fluid is caused to flow in a swirly manner along the cylindrically-shaped inner surfaces so as to wash the inner surfaces.

3. The discharged toner collecting method according to claim 2, wherein the washing fluid is a liquid, a gas, or a grain-like material capable of removing discharged toner adhered on the inner surface of the discharged toner nozzle or the connecting portion.

4. The discharged toner collecting method according to claim 1, wherein the washing fluid is a liquid, a gas, or a grain-like material capable of removing discharged toner adhered on the inner surface of the discharged toner nozzle or the connecting portion.

5. A discharged toner collecting apparatus including at least a discharged toner box for storing discharged toner, a discharged toner nozzle for injecting discharged toner into the discharged toner box, and a connecting portion which is provided in the discharged toner box and to which the discharged toner nozzle is connected, wherein there is provided, at a position where the discharged toner nozzle and the connecting portion are connected, a washing fluid feeding mechanism for feeding washing fluid to wash an inner surface of the discharged toner nozzle, or both of inner surfaces of the discharged toner nozzle and the connecting portion.

6. The discharged toner collecting apparatus according to claim 5, wherein the washing fluid feeding mechanism comprises a washing fluid tank for storing washing fluid, a washing fluid nozzle for ejecting the washing fluid stored in the washing fluid tank to inner surfaces of the discharged toner nozzle, or both of inner surfaces of the discharged toner nozzle and the connecting portion, and a washing fluid feeding unit for feeding washing fluid stored in the washing fluid tank to the washing fluid nozzle.

7. The discharged toner collecting apparatus according to claim 6, wherein the washing fluid nozzle comprises a circular pipe portion which is provided at an upper portion of the discharged toner nozzle and surrounds the discharged toner nozzle, and flow control vanes which constitute an inside wall provided inside the circular pipe portion and guides washing fluid flowing inside the circular pipe portion to the discharged toner nozzle.

8. The discharged toner collecting apparatus according to claim 6, wherein the discharged toner nozzle is formed in the shape of a cylindrical pipe; and the washing fluid nozzle comprises a circular pipe portion which is provided at an upper portion of the discharged toner nozzle and surrounds the discharged toner nozzle, and one or more flow control vanes which constitute an inside wall provided inside the circular pipe portion and guide the washing fluid flowing inside the circular pipe portion to the discharged toner nozzle so as to cause the washing fluid to flow in a swirly manner.

* * * * *